United States Patent [19]

Alexander

[11] Patent Number: 5,014,482

[45] Date of Patent: May 14, 1991

[54] INSULATION RETAINING APPARATUS

[76] Inventor: Michael E. Alexander, 3616 Ashbury, Ponca City, Okla. 74601

[21] Appl. No.: 361,360

[22] Filed: Jun. 5, 1989

[51] Int. Cl.[5] ..... E04C 1/40

[52] U.S. Cl. ..... 52/506; 52/715

[58] Field of Search ..... 52/506, 509, 715; 403/168, 405.1, 326; 411/517, 518

[56] References Cited

U.S. PATENT DOCUMENTS

| | | | |
|---|---|---|---|
| 639,337 | 12/1899 | Anthony | 403/405.1 |
| 2,527,681 | 10/1950 | Lewis et al. | 52/105 |
| 3,325,198 | 6/1967 | Cruse | 403/168 |
| 3,854,262 | 12/1974 | Brady | 52/506 |
| 4,494,295 | 1/1985 | Herring | 52/506 |
| 4,571,911 | 2/1986 | Dunlap et al. | 52/509 |

*Primary Examiner*—James L. Ridgill, Jr.
*Attorney, Agent, or Firm*—William J. Miller

[57] ABSTRACT

An insulation supporting apparatus for use in attaching blankets of insulation to a surface, such as a wall of a high temperature furnace, which includes a bracket with means at one end to attach the bracket to the surface of the high temperature furnace and the remaining end having an opening therethrough for inserting a cylindrical tube or rod which has a taper on each end for ease in inserting the rod through a folded insulation blanket.

2 Claims, 1 Drawing Sheet

FIG. 1
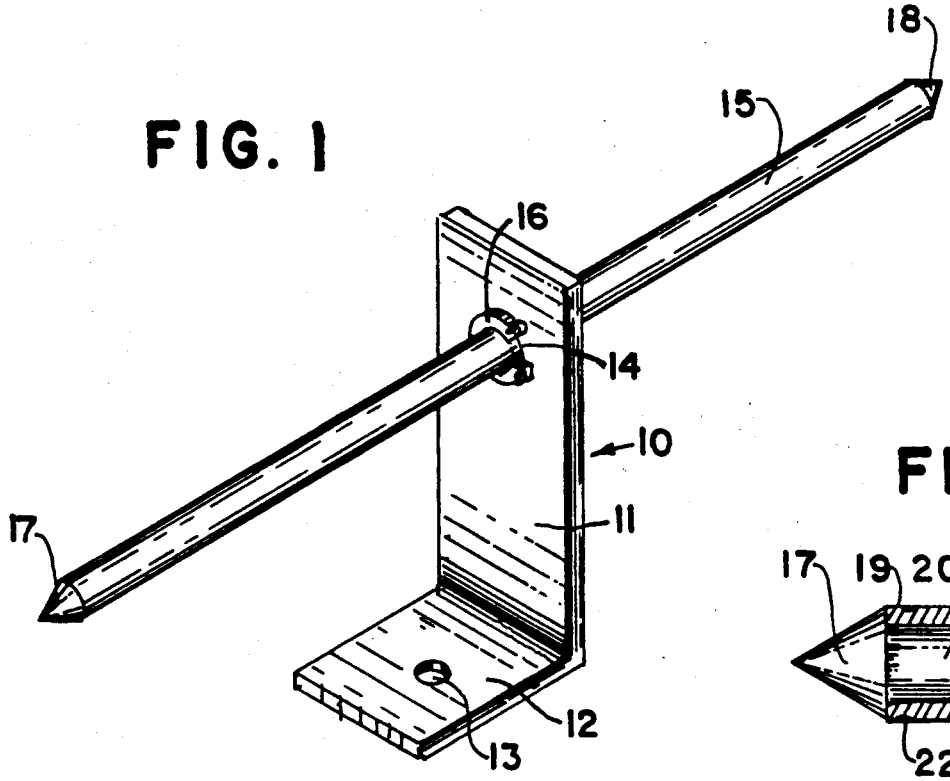
FIG. 2
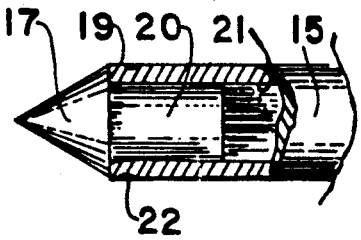
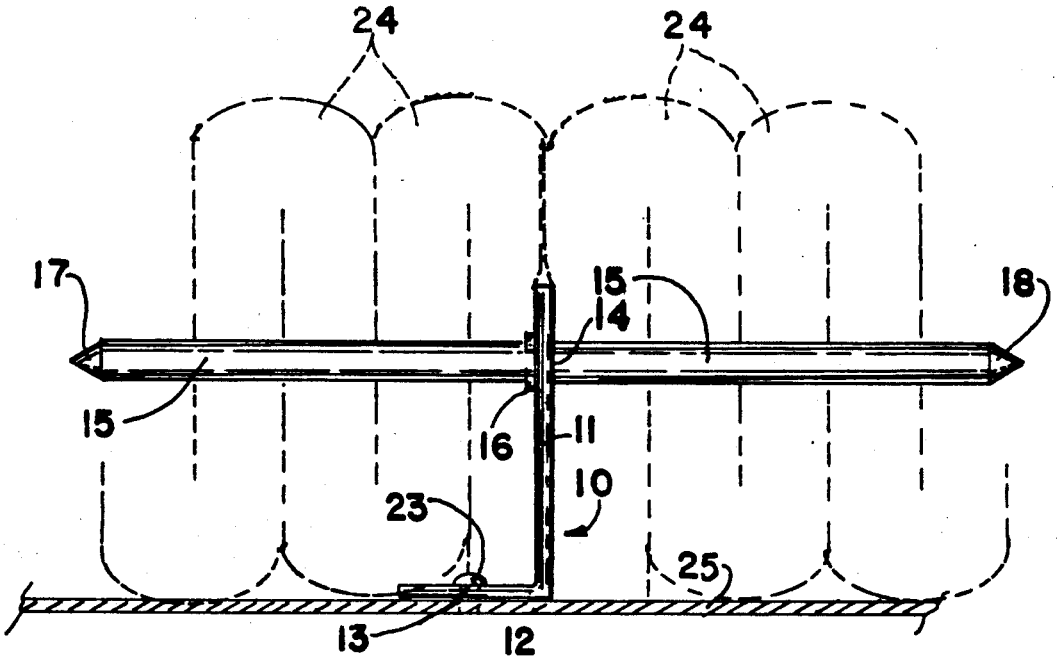
FIG. 3

INSULATION RETAINING APPARATUS

BRIEF DESCRIPTION OF THE PRIOR ART

The best prior art known to Applicant is U.S. Pat. No. 4,571,911. This patent basically comprises an insulating supporting apparatus which comprises an "L" shaped bracket with means for attaching a base portion of the bracket to the surface of a. furnace, for example. The end extending from the surface has a slot which is angled to the longitudinal axis of the bracket. A tine extends longitudinally through the slot and extends on each side of the bracket, the tine being substantially parallel to the surface of the furnace. On each end of the tine are points for inserting the insulation material onto the tine and the tine further includes indentations to prevent the tine from sliding further than a predetermined distance into the aforementioned slot.

The modular insulation anchor previously described has a substantial problem when vibration is present on or along the surface of the furnace. The sharp edges of the tine tend to cut into and cause destruction of the blankets of insulation folded over the tine. Over a period of time, the insulation can become dislodged and fall from the supporting anchors, thereby causing the furnace to loose its insulation characteristics, thereby necessitating immediate repair of the furnace.

BRIEF DESCRIPTION OF THE INVENTION

This invention utilizes a tube having a preferred circular cross-section as the insulation retaining member. The tubular cross-section, rather than cutting the insulation as does the aforementioned tine, will move between the various fibers rather than cutting them. The circular cross-section does not cause ultimate destruction of the insulation, but rather protects the insulation from being cut. Therefore, the insulation does not ultimately become dislodged or fall from the insulation anchors. The tubular tines have points at each end so that they can be easily inserted through the blankets of insulation or that the blankets of insulation can easily be inserted onto the tines.

BRIEF DESCRIPTION OF THE FIGURES

FIG. 1 is an orthogonal projection of the improved modular insulation anchor;

FIG. 2 is a partial cross-sectional view of one end of the tubular portion of the modular insulation anchor; and, FIG. 3 is a view of the insulation anchor installed against a surface, such as a furnace, with insulation impaled thereon.

DETAILED DESCRIPTION OF THE INVENTION

The modular insulation support generally comprises an "L" shaped bracket 10 having an upper portion 11 and an anchor portion 12. Anchor portion 12 can be welded directly to a surface or can accommodate a bolt through hole 13. Upper portion has an opening 14 which has a tubular rod 15 inserted therethrough. Tubular rod 15 is normally inserted halfway along its length into hole 14 where a clip 16 is utilized to positioned tubular rod 15 so that it will be retained approximately halfway along bracket 10. At each end of rod 15 are ends 17 and 18 which are tapered or pointed for ease in inserting tubular rod 15 into a bundle of ceramic fiber insulation or for inserting ceramic fiber insulation onto tubular rod 15.

Referring in particular to FIG. 2, it can be noted that end 17 comprises a neck 19 and a portion 20 of lessor diameter than the outside diameter of tubular rod 15. Diameter of portion 20 should be equal to or less than the inside diameter 21 of tubular rod 15. If tapered end 17 is not forced into the end of tubular rod 15, then the end maybe retained by rolling at location 22, for example, in order to adequately secure tapered point 17 or 18 into tubular rod 15.

Referring to FIG. 3, a surface 25 has anchored thereon bracket 10 with portion 12 anchored through hole 13 utilizing a bolt 23, for example. It is obvious that if desired, bracket 10 can be welded to surface 25, riveted to surface 25 or any other usual manner of anchoring bracket 10 to surface 25. If bracket 10 is anchored to surface 25 by welding, then only upper portion 11, for example, is needed and lower portion 12 would not be needed or necessary unless desired by the person making the installation. Insulation blankets 24, are then inserted over end 17, for example, and slid along rod 15 to form a solid bundle of insulation material 24 against surface 25.

OPERATION

The apparatus functions by anchoring base 12 in some manner to surface 25 being insulated and forcing or pushing rod 15 using point 17 or point 18, for example, into insulation 24 that has been folded to form a bundle. Insulation 24 is normally folded up to bracket 10 and then the remaining insulation is folded and inserted against point 18, for example, up to the length of rod 15. Thus, the insulation is easily anchored by the arrangement shown in FIGS. 1 and 3. One distinct advantage of this particular type modular anchor over the anchor of the prior art is that vibration, either vertically or horizontally will not cause rod 15 to cut fiber insulation 24 so that it will become fractured and fall or become dislodged from rod 15, necessitating repair of the insulation. The circular cross-section will definitely cause an improved performance for the insulation retaining means.

While a circular cross-section has been shown, it is obvious that other cross-sections can be utilized and still be well within the spirit and scope of the invention. The important thing is that it does not contain sharp edges and that it has a gradually rounding edge so that the insulation will be separated, rather than fractured or cut as is the case of the prior art apparatus.

It is obvious, of course, that other modifications can be made and still be well within the spirit and scope of this invention as described in the specifications and appended claims.

What I claim is:

1. An insulation supporting apparatus for use in attaching blanket insulation to a surface comprising:

(a) a rectangular stud member having a longitudinal axis and a first and second end, means at said first end for attachment to a surface to be insulated, and openings means at said second end;

(b) and elongated cylindrical member, said elongated cylindrical member having a first and second end and wherein said first and second ends are tapered to a point;

(c) means for retaining said elongated cylindrical member in said opening formed in said rectangular stud means at a location substantially midway along its length; and, (d) wherein said means for retaining is a snap ring which is positioned over said elongated cylindrical member and biased against said elongated cylindrical member with a force sufficient to retain said elongated cylindrical member positioned with respect to said rectangular stud member.

2. Apparatus as claimed in claim 1 wherein said stud member is bent in an "L" shape with said circular opening at one end of said "L" shape and means in said second portion of said "L" shape to attach said "L" shape to said surface.

* * * * *